US009506645B1

(12) United States Patent
Tom

(10) Patent No.: US 9,506,645 B1
(45) **Date of Patent: *Nov. 29, 2016**

(54) 70 CFM BATH FAN WITH RECESSED CAN AND TELESCOPING SIDE SUSPENSION BRACKETS

(71) Applicant: Chien Luen Industries Co., Ltd., Inc., Oakland Park, FL (US)

(72) Inventor: Lawrence Tom, Smryna, GA (US)

(73) Assignee: Chien Luen Industries Co., Ltd., Inc., Oakland Park, FL (US)

( * ) Notice: Subject to any disclaimer, the term of this patent is extended or adjusted under 35 U.S.C. 154(b) by 136 days.

This patent is subject to a terminal disclaimer.

(21) Appl. No.: 14/561,479

(22) Filed: Dec. 5, 2014

Related U.S. Application Data

(62) Division of application No. 13/237,544, filed on Sep. 20, 2011, now Pat. No. 8,961,126.

(60) Provisional application No. 61/385,697, filed on Sep. 23, 2010, provisional application No. 61/385,016, filed on Sep. 21, 2010.

(51) Int. Cl.
*F21V 33/00* (2006.01)
*F04D 19/00* (2006.01)

(52) U.S. Cl.
CPC ..... *F21V 33/0096* (2013.01); *F04D 19/002* (2013.01)

(58) Field of Classification Search
CPC ..... F21V 33/0096; F04D 19/002
USPC ..... 416/5
See application file for complete search history.

(56) References Cited

U.S. PATENT DOCUMENTS

| | | | | |
|---|---|---|---|---|
| 1,823,479 A | | 9/1931 | Venderbush | |
| 2,519,503 A | | 8/1950 | Rigaumont | |
| 2,689,906 A | * | 9/1954 | Corbett | F24H 3/0411 219/213 |
| 2,697,163 A | * | 12/1954 | Spear | F04D 29/646 219/213 |
| 2,798,659 A | * | 7/1957 | Tweedy | F04D 17/16 417/353 |

(Continued)

OTHER PUBLICATIONS

Tom, Lawrence, Office Action Summary mailed Nov. 7, 2014 for U.S. Appl. No. 13/289,312, filed Nov. 4, 2011, 14 pages.

(Continued)

*Primary Examiner* — Igor Kershteyn
*Assistant Examiner* — Eldon Brockman
(74) *Attorney, Agent, or Firm* — Brian S. Steinberger; Law Offices of Brian S. Steinberger, P.A.

(57) ABSTRACT

Apparatus, systems and methods of 70 (seventy) CFM (cubic feet per minute) ventilation fans for bathrooms with recessed can with light and having the motor partially inside and beneath the blower wheel. A housing for the bath fan can be attached to joists in the ceiling by a long telescoping mounting brackets. The motor and blower wheel can be attached to a mounting plate inside of the housing, which can be removed as a single unit to allow the motor to be easily replaced or repaired, and also to allow for the inside of the housing to be inspected during and after installation of the exhaust fan. A ring about the light can have vents that receive incoming air into the fan, which is exhausted therefrom by the blower. Seals such as elastomeric rings can seal the bottom of the can to the light, and the top end of the can to the decorative ring shaped pan. A vertical panel can separate a first compartment having the motor and blower from a second adjacent compartment having the light.

20 Claims, 13 Drawing Sheets

(56) References Cited

U.S. PATENT DOCUMENTS 2,950,859 A 8/1960 Kirk
3,065,686 A 11/1962 Geocaris
3,068,341 A 12/1962 Ortiz
3,125,943 A 3/1964 Geocaris et al.
3,223,019 A 12/1965 Schuh
3,227,063 A 1/1966 Lambert
3,246,137 A 4/1966 Zagel
3,309,502 A * 3/1967 Witherspoon, Jr. .. F24H 3/0411 219/220
3,665,838 A 5/1972 Shepard
3,785,271 A * 1/1974 Joy ..... F24F 13/078 219/220
3,796,249 A 3/1974 McCabe
3,909,589 A * 9/1975 Stone ..... F21V 33/0092 219/220
4,510,851 A 4/1985 Sarnosky et al.
4,526,318 A 7/1985 Fleming et al.
4,537,117 A 8/1985 Cavestany et al.
4,589,476 A 5/1986 Berner
4,616,696 A 10/1986 Brundrett et al.
4,657,291 A 4/1987 Kurosaki
4,681,024 A 7/1987 Ivey
4,726,559 A 2/1988 Hultmark
4,798,518 A 1/1989 Holzberger et al.
4,867,640 A 9/1989 Penlesky
4,954,049 A 9/1990 Armbruster
5,232,152 A 8/1993 Tsang
5,567,200 A 10/1996 Swartzendruber
5,620,370 A 4/1997 Umai et al.
5,934,783 A 8/1999 Yoshikawa
6,161,175 A 12/2000 Kim
6,215,885 B1 4/2001 Geiger
6,261,175 B1 7/2001 Larson
6,329,908 B1 12/2001 Frecska
6,340,237 B1 1/2002 Koga
D457,232 S 5/2002 Miura
D457,616 S 5/2002 Yamanaka
6,384,352 B1 5/2002 Ellman
6,488,579 B2 12/2002 Larson
6,538,881 B1 3/2003 Jeakins
6,632,006 B1 10/2003 Rippel et al.
6,802,770 B2 10/2004 Larson
6,897,580 B2 5/2005 White
6,979,169 B2 12/2005 Penlesky
D521,145 S 5/2006 Craw
7,128,303 B2 10/2006 Penlesky
D535,433 S 1/2007 Craw
7,175,309 B2 * 2/2007 Craw ..... F21V 29/02 362/149
7,203,416 B2 * 4/2007 Craw ..... F24H 3/0411 392/350
D565,716 S 4/2008 Jacak
D575,387 S 8/2008 Zakula
D577,805 S 9/2008 Adrian
D581,508 S 11/2008 Miyake
7,455,432 B2 * 11/2008 Craw ..... F21V 29/02 362/149
7,455,500 B2 11/2008 Penlesky
7,481,559 B1 1/2009 Rashidi
7,591,867 B2 9/2009 Choi et al.
7,606,379 B2 10/2009 Ivey
7,654,495 B2 2/2010 Adrian
7,677,964 B1 3/2010 Bucher et al.
7,845,803 B2 12/2010 Lv et al.
7,881,827 B2 2/2011 Park
7,922,335 B2 4/2011 Sakai et al.
7,993,037 B1 8/2011 Buse
8,033,687 B2 * 10/2011 Wang ..... F21V 29/004 362/249.02
D653,323 S 1/2012 Jacak
8,104,502 B2 1/2012 Nakata et al.
D654,998 S 2/2012 Zakula
8,113,148 B2 2/2012 Chem
8,172,655 B2 5/2012 Liu
8,218,805 B2 7/2012 Hornback
8,295,504 B2 10/2012 Ady
D681,249 S 4/2013 Tom
8,434,916 B2 * 5/2013 Craw ..... F21V 29/02 362/149
8,485,696 B2 7/2013 Pringle
8,591,037 B2 11/2013 Nagumo et al.
8,814,513 B2 * 8/2014 Yang ..... F24F 7/065 415/213.1
8,956,113 B2 * 2/2015 Yang ..... F24F 7/065 415/213.1
8,961,126 B1 2/2015 Tom
9,022,622 B2 * 5/2015 Craw ..... F21V 29/02 362/149
9,022,846 B1 5/2015 Tom
9,028,212 B1 5/2015 Tom
9,097,265 B1 8/2015 Tom
9,103,104 B1 8/2015 Tom
9,175,874 B1 11/2015 Tom
9,188,132 B1 11/2015 Tom
9,414,142 B1 8/2016 Zauhar
2005/0006549 A1 1/2005 Liu
2005/0111972 A1 5/2005 Penlesky
2005/0117341 A1 * 6/2005 Craw ..... F21V 29/02 362/253
2006/0172693 A1 8/2006 Lundquist
2006/0199515 A1 9/2006 Lasko
2007/0131827 A1 6/2007 Nevers
2007/0201236 A1 * 8/2007 Craw ..... F21V 29/02 362/373
2008/0261508 A1 10/2008 Deng
2008/0318515 A1 12/2008 Yeung
2009/0028372 A1 1/2009 Cerasuolo
2009/0073702 A1 * 3/2009 Craw ..... F21V 29/02 362/373
2009/0116189 A1 5/2009 Chang
2009/0170421 A1 * 7/2009 Adrian ..... F24F 7/06 454/349
2010/0009621 A1 * 1/2010 Hsieh ..... F21V 33/0096 454/293
2010/0112927 A1 5/2010 Marga et al.
2010/0112929 A1 * 5/2010 Iantorno ..... F24F 7/065 454/275
2010/0171681 A1 7/2010 Cabanas
2010/0226139 A1 * 9/2010 Lynch ..... F21S 8/02 362/373
2010/0328960 A1 * 12/2010 Wang ..... F21V 29/004 362/373
2012/0250335 A1 10/2012 Nakano
2012/0274767 A1 11/2012 Hornback
2013/0084793 A1 4/2013 Yang
2013/0114826 A1 5/2013 Chang
2013/0266443 A1 * 10/2013 Yang ..... F24F 7/065 416/5
2013/0272002 A1 * 10/2013 Craw ..... F21V 29/02 362/373
2013/0315731 A1 * 11/2013 Yang ..... F04D 25/088 416/5
2014/0112781 A1 * 4/2014 Yang ..... F24F 7/065 416/5
2014/0177900 A1 6/2014 Berkman et al.
2015/0110626 A1 * 4/2015 Yang ..... F24F 7/065 416/5

OTHER PUBLICATIONS

Tom, Lawrence, Listing of pending claims for U.S. Appl. No. 13/289,312, filed Nov. 4, 2011, 7 pages.
Tom, Lawrence, Office Action Summary mailed Oct. 22, 2014 for U.S. Appl. No. 13/042,992, filed Mar. 8, 2011, 16 pages.
Tom, Lawrence, Listing of pending claims for U.S. Appl. No. 13/042,992, filed Mar. 8, 2011, 7 pages.
Tom, Lawrence, Office Action mailed Jan. 8, 2015 for U.S. Appl. No. 13/233,700, filed Sep. 15, 2011, 25 pages.
Tom, Lawrence, Amendment Response filed Oct. 3, 2014 for U.S. Appl. No. 13/233,700, filed Sep. 15, 2011, 13 pages.

* cited by examiner

70 CFM BATH FAN WITH RECESSED CAN AND TELESCOPING SIDE SUSPENSION BRACKETS

This application is a Divisional Application of U.S. patent application Ser. No. 13/237,544 filed Sep. 20, 2011, now U.S. Pat. No. 8,961,126, which claims the benefit of priority to U.S. Provisional Patent Application 61/385,016 filed Sep. 21, 2010 and U.S. Provisional Patent Application 61/385,697 filed Sep. 23, 2010. The entire disclosure of each of the applications listed in this paragraph are incorporated herein by specific reference thereto.

FIELD OF INVENTION

This invention relates to ventilation exhaust fans, and in particular to apparatus, systems and methods of 70 CFM ventilation fans for bathrooms with recessed cans and telescoping side mounted slide suspension mounting brackets.

BACKGROUND AND PRIOR ART

Various types of bathroom ventilation fans have been proposed over the years. See for example, U.S. Pat. No. 4,867,640 to Penlesky et al.; U.S. Pat. No. 4,510,851 to Sarnosky et al.; U.S. Pat. No. 6,261,175 to Larson et al.; U.S. Pat. No. 6,488,579 to Larson et al.; U.S. Pat. No. 6,802,770 to Larson et al.; U.S. Pat. No. 7,203,416 to Craw et al.; and U.S. Pat. No. 7,654,495 to Adrian et al.

There have been many problems with the prior art. For example, many bath fans are difficult to be installed into a ceiling since the housings cannot be easily attached to different locations of joists in the ceiling. If a joist is off center to the middle of bathroom ceiling the bath fan is not easy to center in the room. Additionally, many of the bath fans have numerous parts which add extra manufacturing costs. And as a result a bath fan that requires assembly of the bath fan at a job site will incur undesirable extra labor and material costs to install. Additionally, many bath fans have to be wired to components inside of the housings which also requires extra expensive labor costs to make the connections onside during the installation of the bath fan.

Thus, the need exists for solutions to the above problems with the prior art.

SUMMARY OF THE INVENTION

A primary objective of the present invention is to provide ventilation fans, apparatus, systems and methods for installing bathroom fans with recessed cans that provides 70 (seventy) CFM (cubic feet of air per minute) in ventilation.

A secondary objective of the present invention is to provide ventilation fans, apparatus, systems and methods for installing bathroom fans with slide suspension brackets that provides 70 (seventy) CFM (cubic feet of air per minute) in ventilation.

A third objective of the present invention is to provide ventilation fans, apparatus, systems and methods for installing bathroom fans with slide suspension brackets with internal mounted motor and blower without a separate blower housing.

A fourth objective of the present invention is to provide ventilation fans, apparatus, systems and methods for installing bathroom fans with slide suspension brackets using two piece deflectors around a blower to direct airflow.

A fifth objective of the present invention is to provide ventilation fans, apparatus, systems and methods for installing bathroom fans with slide suspension brackets with blowers formed from minimal components.

A sixth object of the present invention is to provide ventilation fans, apparatus, systems and methods for installing bathroom fans where the motor and blower can be removed in one piece from the housing in order to replace or repair the components, and/or to allow for inspection of the components during installation.

A seventh objective of the present invention is to provide ventilation fans, apparatus, systems and methods for installing bathroom fans, having recessed lights with sealing members that prevent air and moisture from a bathroom from entering into and contacting light components such as bulbs inside of the fan.

An embodiment of the ventilation exhaust fan, can include a housing having closed top, side walls and open bottom, and an outlet, a blower wheel inside of the housing, a motor mounted partially inside of and extending from an inside of the blower wheel, a recessed can mounted to the open bottom of the housing adjacent to the wheel and motor, the recessed can having a generally conical shape with a large open end, and a narrow open end, and a light in the recessed can adjacent to the narrow open end, the light being air sealed with the narrow open end, wherein air enters into the housing about the large open end of the can about the can, and not through the can, with the air exhausted from the outlet of the housing by the motor run blower.

The motor can be an approximately 70 (seventy) CFM (cubic feet per minute) generating motor. The fan can include an first elongated side telescoping bracket directly mounted along one side wall of the housing for mounting the housing to structural supports within a ceiling. The fan can include a second elongated side telescoping bracket directly mounted along an opposite side wall of the housing for mounting the housing to structural supports within the ceiling, the second elongated side telescoping bracket being shorter than the first elongated side telescoping bracket.

The fan can include can be a recessed shade, such as a decorative pan having vents about the large open end of the light shade, wherein air enters through the vents into the exhaust fan and passes about an exterior surface of the light shade.

The fan can include an elastomeric sealing ring for sealing the large open end of the can to the decorative pan, so that moisture and air does not pass into the recessed can. The fan include an elastomeric sealing ring for sealing the narrow open end of the can to the light, so that moisture and air does not pass into the recessed can.

The fan can include a motor mounting plate having an opening therethrough, and a generally U-shaped motor bracket attached to the motor mounting plate for mounting the motor in the opening of the motor mounting plate, with the blower wheel to one side of the motor mounting plate, wherein the motor mounting plate with the mounted motor and blower wheel are both insertable into the housing as a single unit, and are removable from the housing as the single unit.

The fan can include a removable vertical panel in the housing between the recessed can and the motor mounted blower wheel, and a first male plug and a first female receptacle connecting power to the light, and a second male plug and a second female receptacle connecting power to the motor.

The ventilation exhaust fan can include a housing having closed side walls, open top end and closed bottom, a blower wheel inside of the housing, a motor partially inside of and extending from the blower wheel in the housing, a recessed can in the housing next to the blower wheel and motor, the recessed can having a large open end and a narrow open end, a light mounted in the narrow open end of the recessed can, a ring shaped pan having vents about a perimeter edge of the pan positioned about the large open end of the recessed can, the vents for allowing incoming air to pass into the housing through the motor run blower, a sealing member attached to the recessed can for preventing the incoming air from entering into the recessed can and contacting the light, and an outlet for exhausting the air outside of the exhaust fan.

The sealing member can include an elastomeric sealing ring for sealing the large open end of the can to the ring shaped pan, so that moisture and air does not pass into the recessed can. The sealing member can also include an elastomeric sealing ring for sealing the narrow open end of the can to the light, so that moisture and air does not pass into the recessed can.

The fan can include a motor mounting plate having an opening therethrough, and a generally U-shaped motor bracket attached to the motor mounting plate for mounting the motor in the opening of the motor mounting plate, with the blower wheel to one side of the motor mounting plate, wherein the motor mounting plate with the mounted motor and blower wheel are both insertable into the housing as a single unit, and are removable from the housing as the single unit.

The fan can include a removable vertical panel in the housing between the recessed can and the motor mounted blower wheel, a first male plug and a first female receptacle connecting power to the light, and a second male plug and a second female receptacle connecting power to the motor.

The fan can include an elongated side telescoping bracket directly mounted along one side wall of the housing for mounting the housing to structural supports such as joist(s) within a ceiling.

The ventilating exhaust fan can include a housing having closed sides, an open top and a closed bottom, and an outlet, a blower wheel inside of the housing, a motor mounted to the blower wheel, a motor mounting plate having an opening therethrough, a generally U-shaped motor bracket attached to the motor mounting plate for mounting the motor in the opening of the motor mounting plate, with the blower wheel to one side of the motor mounting plate, wherein the motor mounting plate with the mounted motor and blower wheel are both insertable into the housing as a single unit, and are removable from the housing as the single unit, a light inside of the housing, and a seal member for preventing air coming into the housing from contacting the light.

The fan can include a recessed can in the housing next to the blower wheel and the motor, the recessed can having a large open end and a narrow open end, wherein the light being mounted in the narrow open end of the recessed can, and a ring shaped pan having vents about a perimeter edge of the pan positioned about the large open end of the recessed can, the vents for allowing the incoming air to pass into the housing through the motor run blower.

The sealing member can include a first elastomeric sealing ring for sealing the large open end of the can to the ring shaped pan, so that moisture and air does not pass into the recessed can, and a second elastomeric sealing ring for sealing the narrow open end of the can to the light, so that moisture and air does not pass into the recessed can.

Further objects and advantages of this invention will be apparent from the following detailed description of the presently preferred embodiments which are illustrated schematically in the accompanying drawings.

DESCRIPTION OF THE PREFERRED EMBODIMENTS

Figure 1:
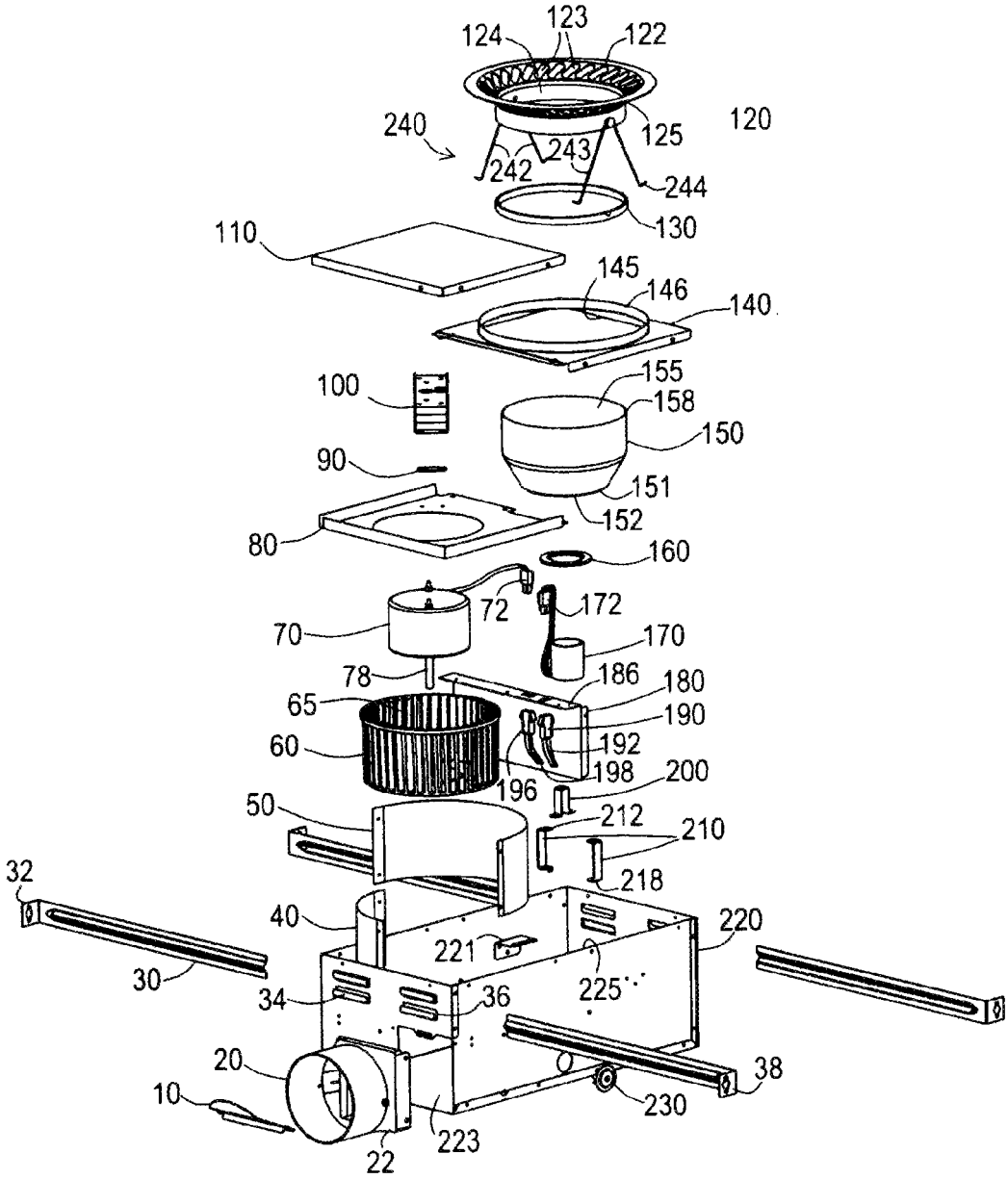
FIG. 1 is an exploded view of all components of the 70 CFM bath fan (with no heater) with recessed can.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

70 CFM Bath Fan with Recessed can

A list of the components for FIGS. 1-13 will now be described.

1. 70 CFM bath fan housing embodiment
10. outlet pivotal plate/deflector
20. outlet
30. hanger bar (galvanized steel) (4)
32. bent tab end
34. bent flange pair
36. bent flange pair
38. bent tab end
40. rectangular curved wind deflector (galvanized steel)
50. rectangular curved wind deflector (galvanized steel)
60. impeller
70. electrical motor
72. male plug from motor
76. fasteners on top of the motor
80. motor mounting plate (galvanized steel)

Figure 2:
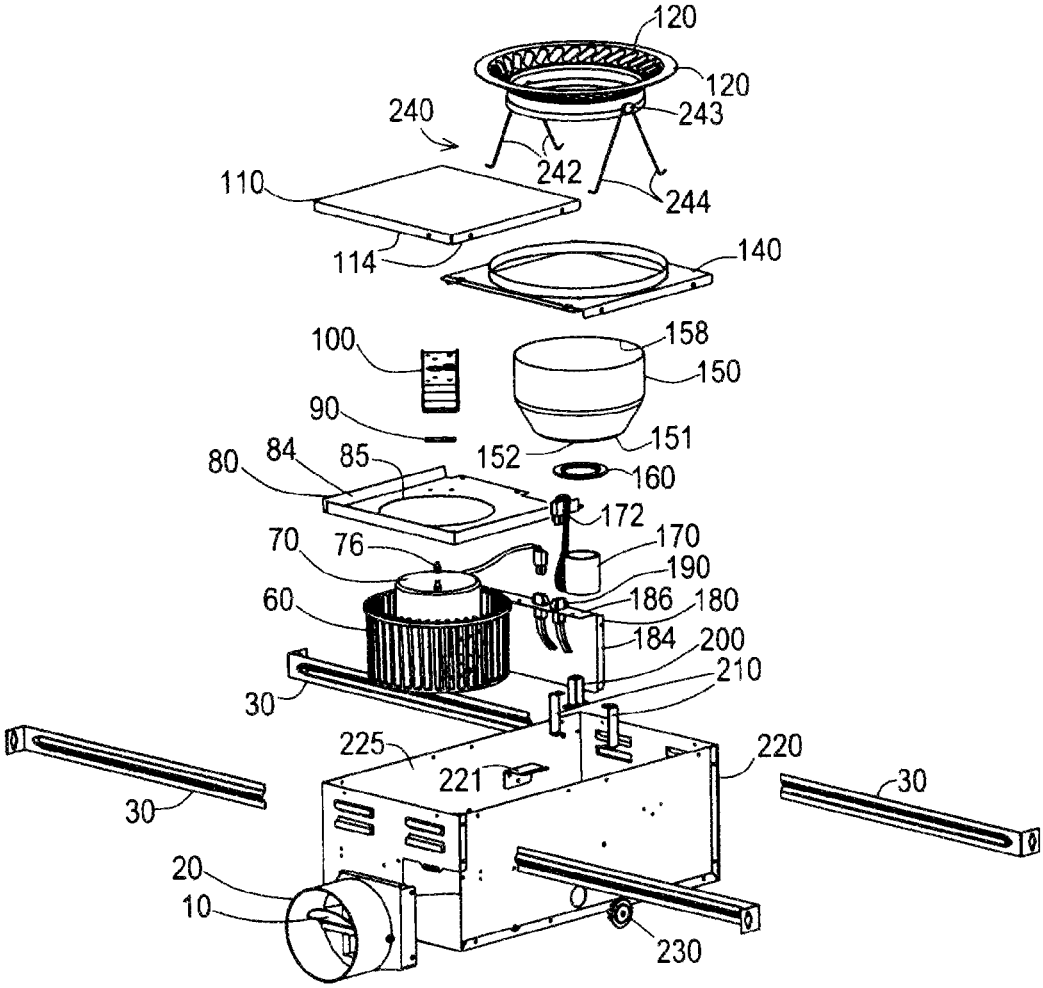
FIG. 2 is an exploded perspective view of the bath fan of FIG. 1 with the motor attached to impeller and lamp socket assembly plug attached to the motor mounting plate.
Figure 3:
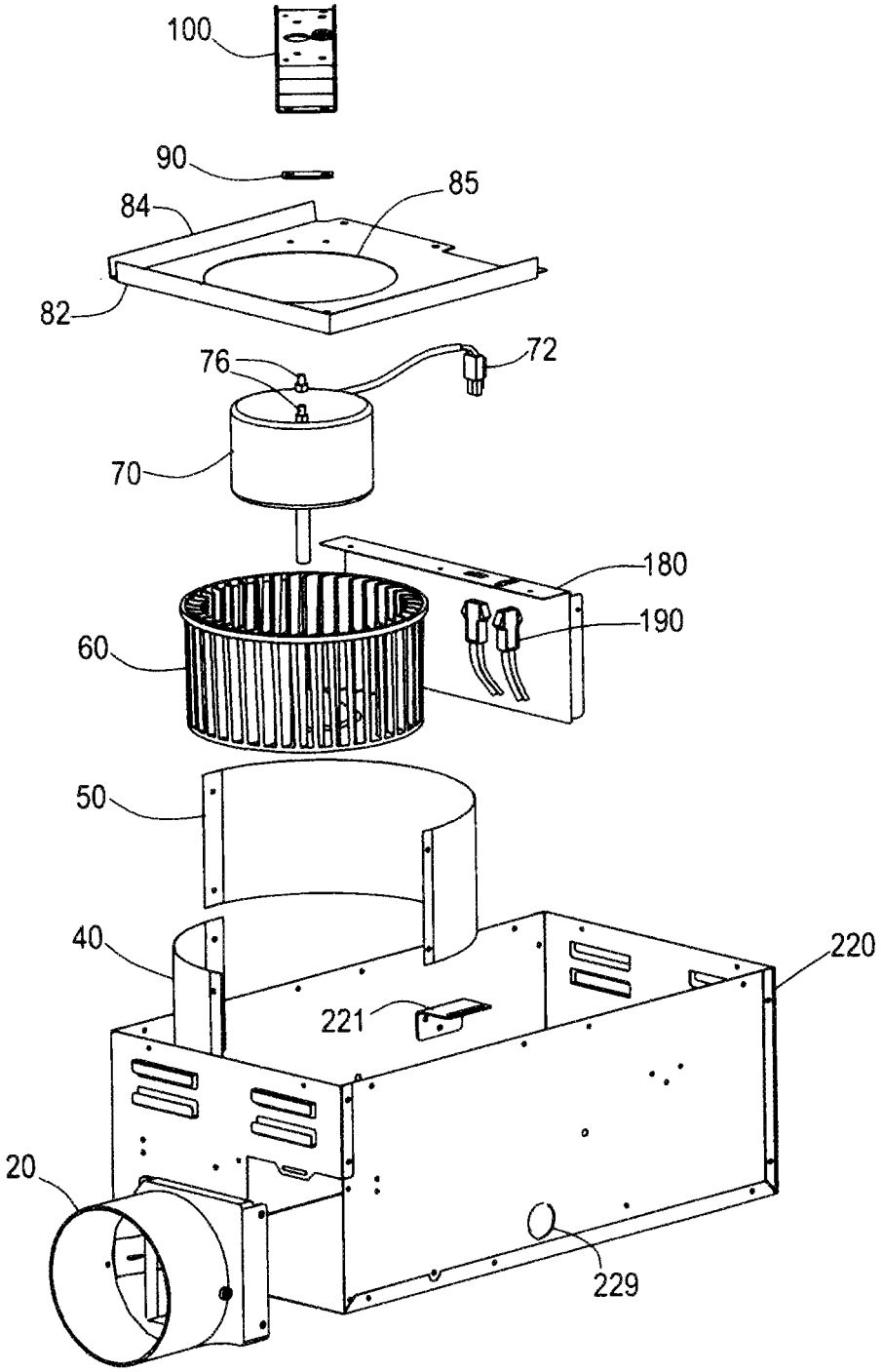
FIG. 3 is another exploded view of the bath fan of FIG. 1 without exterior decorative ring, outer plate cover and light panel.
Figure 4:
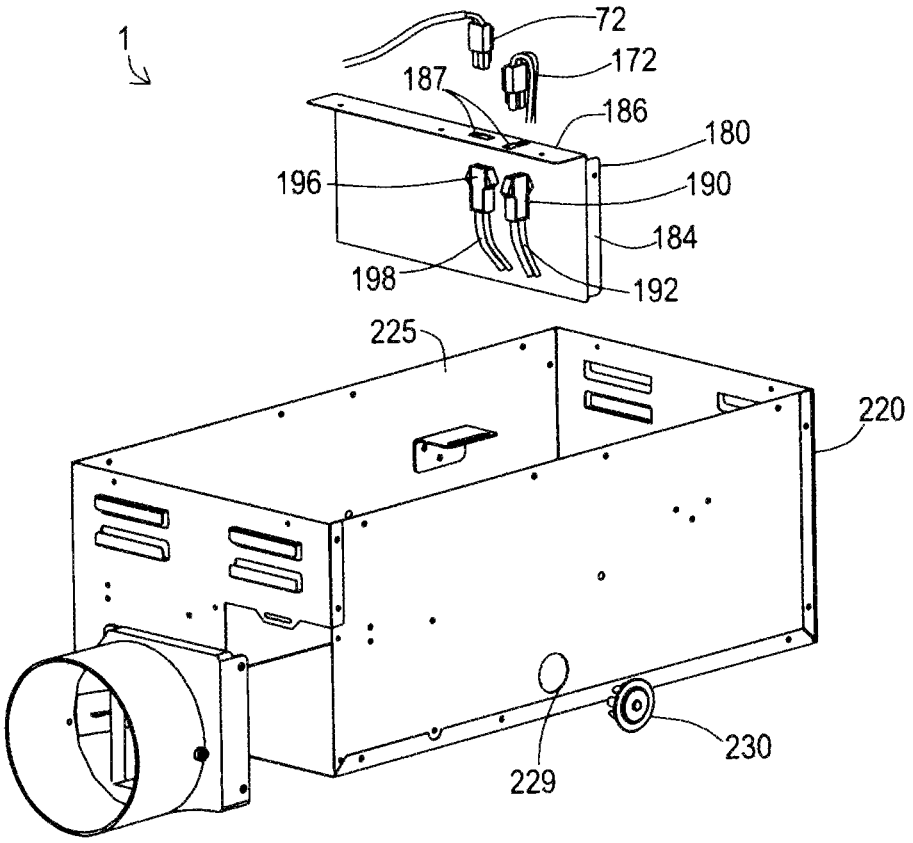
FIG. 4 is another exploded view of the bath fan housing of FIG. 1 with the plug panel holding the female plugs and separated male plugs.

85. opening in mounting plate
90. rubber pad (2)
100. inverted generally U-shaped motor bracket (steel)
102. footer end
108. footer end.
110. plate (galvanized steel)
114. bent edges on plate
120. decorative trim ring with vents
130. rubber ring (silicone rubber)
140. light panel (galvanized steel)
144. bent edges
145. opening in panel
146. upwardly protruding ring
150. lampshade (aluminum)
151. flat ring shaped bottom
152. narrow bottom opening
153. fasteners in bottom of lampshade
158. enlarged upper opening
160. rubber ring (silicon rubber)
170. lamp socket assembly (E27 porcelain socket)
172. male plug from lamp socket
180. plug panel (galvanized steel)
184. bent side edges
186. upper bent edge
187. openings for female receptacles
190. female plug, for lamp socket, 2-pin (2)
192. external power supply line to lamp socket
196. female plug, for motor
198. external power supply line to motor
200. lamp socket bracket (galvanized steel)
210. lampshade bracket (galvanized steel) (2)
212. upper bent end
218. lower bent end
220. housing assembly (galvanized steel) with closed sides and closed bottom
221. L brackets with slots, mounted to inner walls of housing
223. side opening for exhaust outlet
225. open top of housing
229. opening for electrical lines
230. hole plug (galvanized steel)
240. spring clips
242. leg(s) of spring clips
243. apex(s) of spring clips
244. bent lower edge(s)
250. joist
260. ceiling FIG. 1 is an exploded view of all components of the 70 CFM bath fan (with no heater) 1 with recessed can 150. FIG. 2 is an exploded perspective view of the bath fan 1 of FIG. 1 with the motor attached to blower wheel (impeller) 60 and lamp socket assembly plug 172 attached to the motor mounting plate 80. FIG. 3 is another exploded view of the bath fan 1 of FIG. 1 without exterior decorative ring 120, outer plate cover 110 and light panel 140. FIG. 4 is another exploded view of the bath fan housing of FIG. 1 with the plug panel 180 holding the female plugs 190, 196 and separated male plugs 72, 172.

Figure 5:
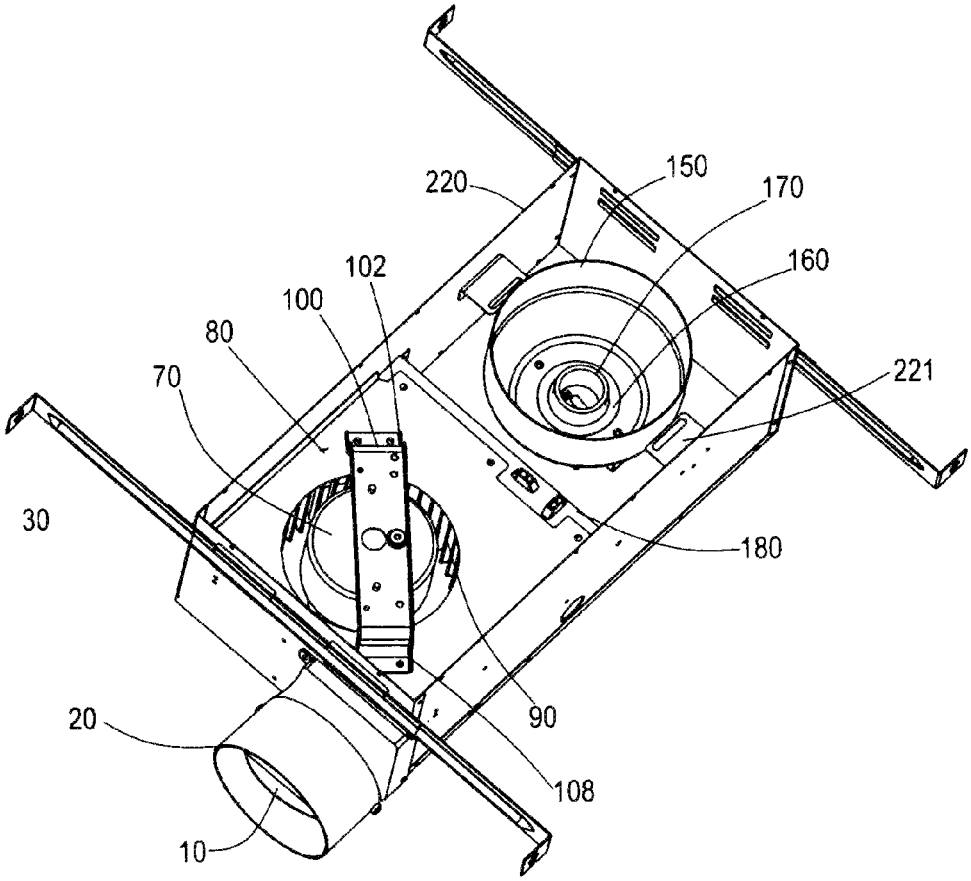
FIG. 5 is a perspective top side view of an assembled bath fan of FIG. 1 without the exterior decorative ring and without the outer plate cover.
Figure 6:
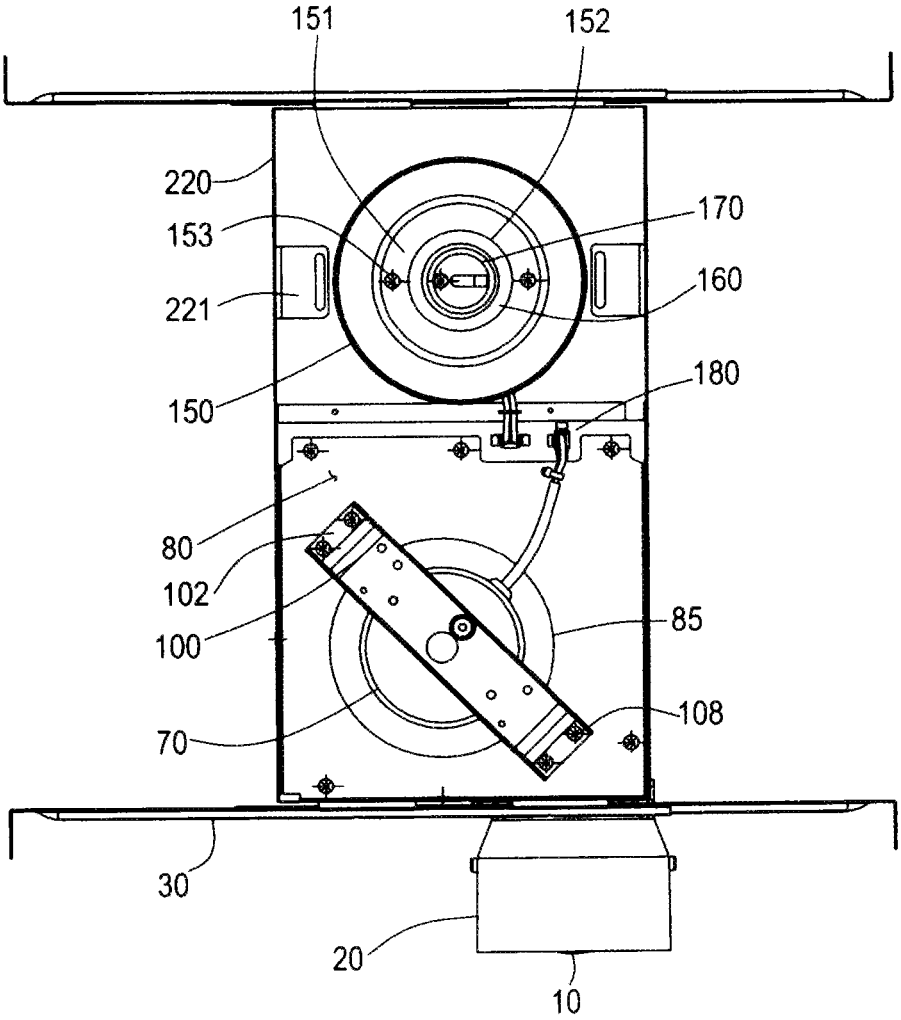
FIG. 6 is a top view of an assembled bath fan of FIG. 5 without the exterior decorative ring and without the outer plate cover.
Figure 7:
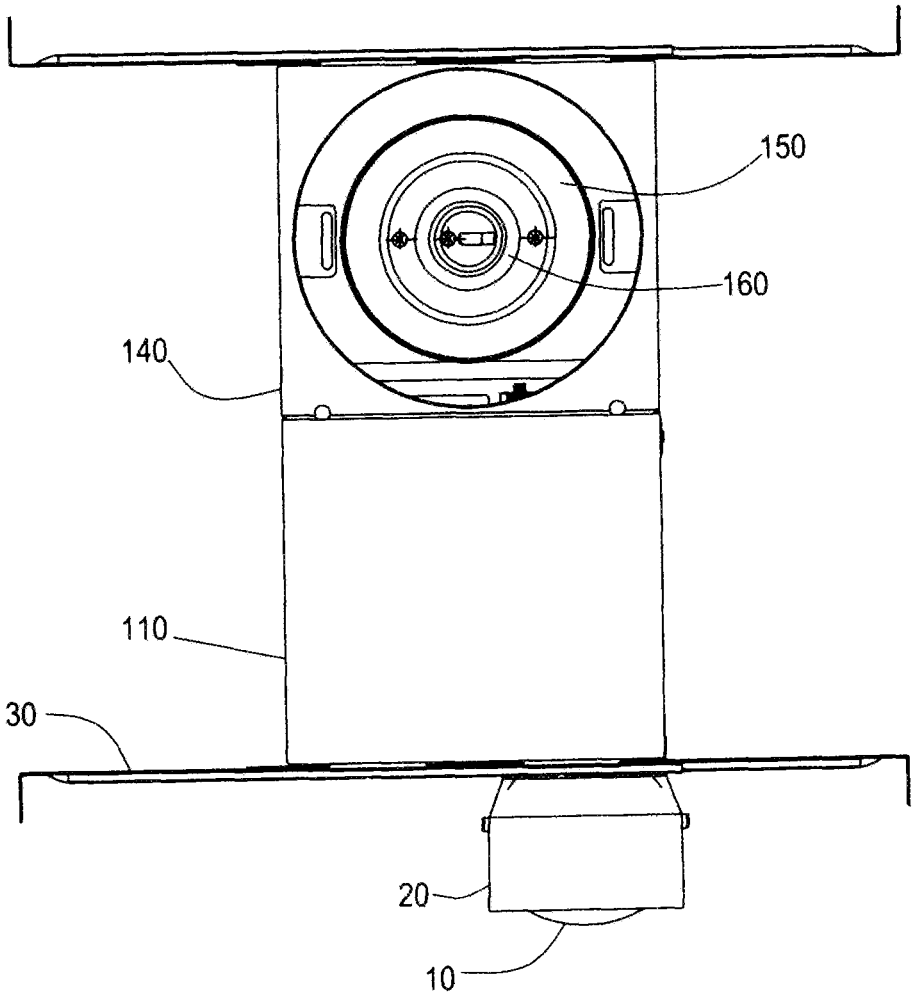
FIG. 7 is another top view of the assembled bath fan of FIG. 6 with the outer plate cover and without the exterior decorative ring.
Figure 8:
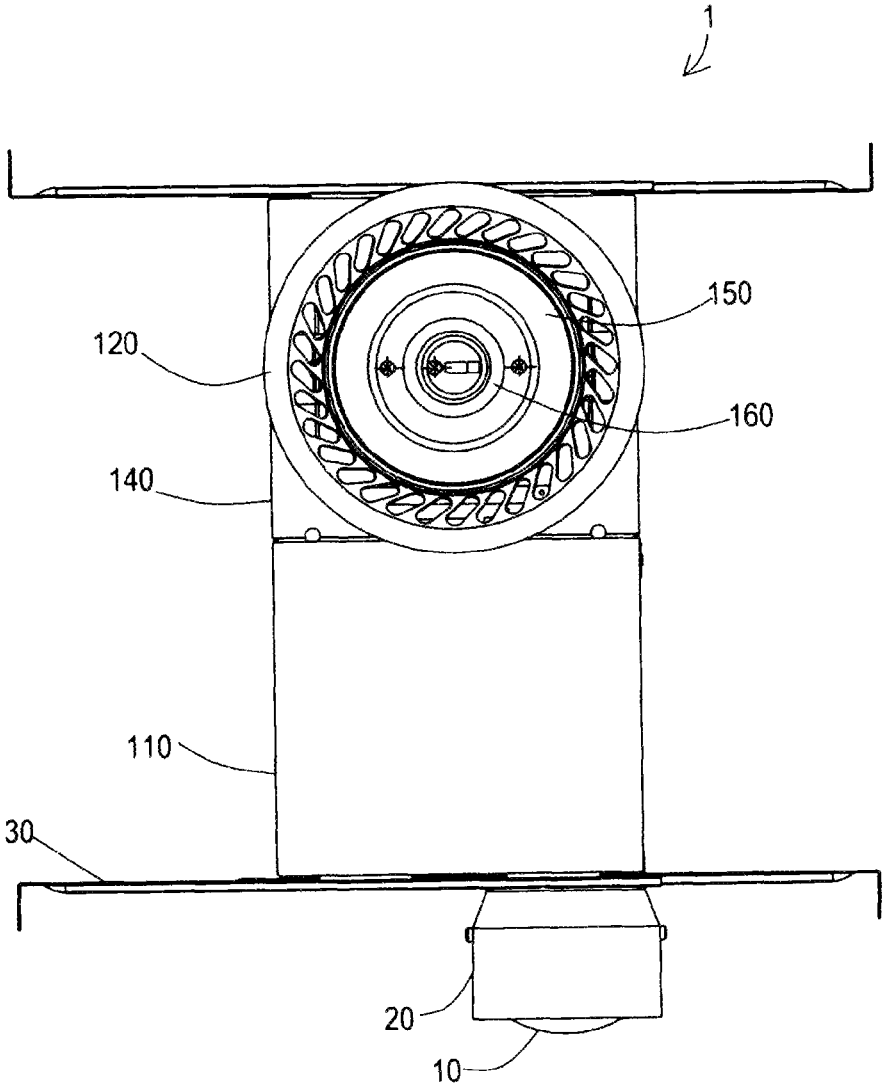
FIG. 8 is another top view of the assembled bath fan of FIG. 7 with the outer plate cover and with the exterior decorative ring.
Figure 9:
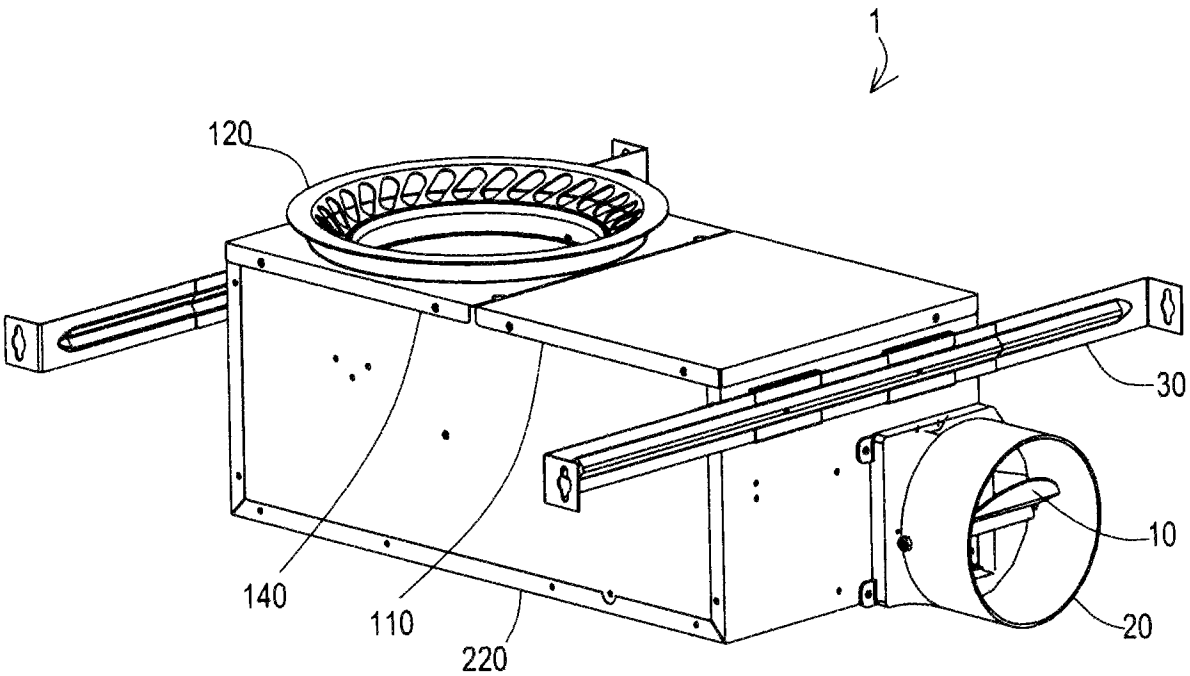
FIG. 9 is a perspective side view of an assembled bath fan of FIGS. 1 and 8.
Figure 10:
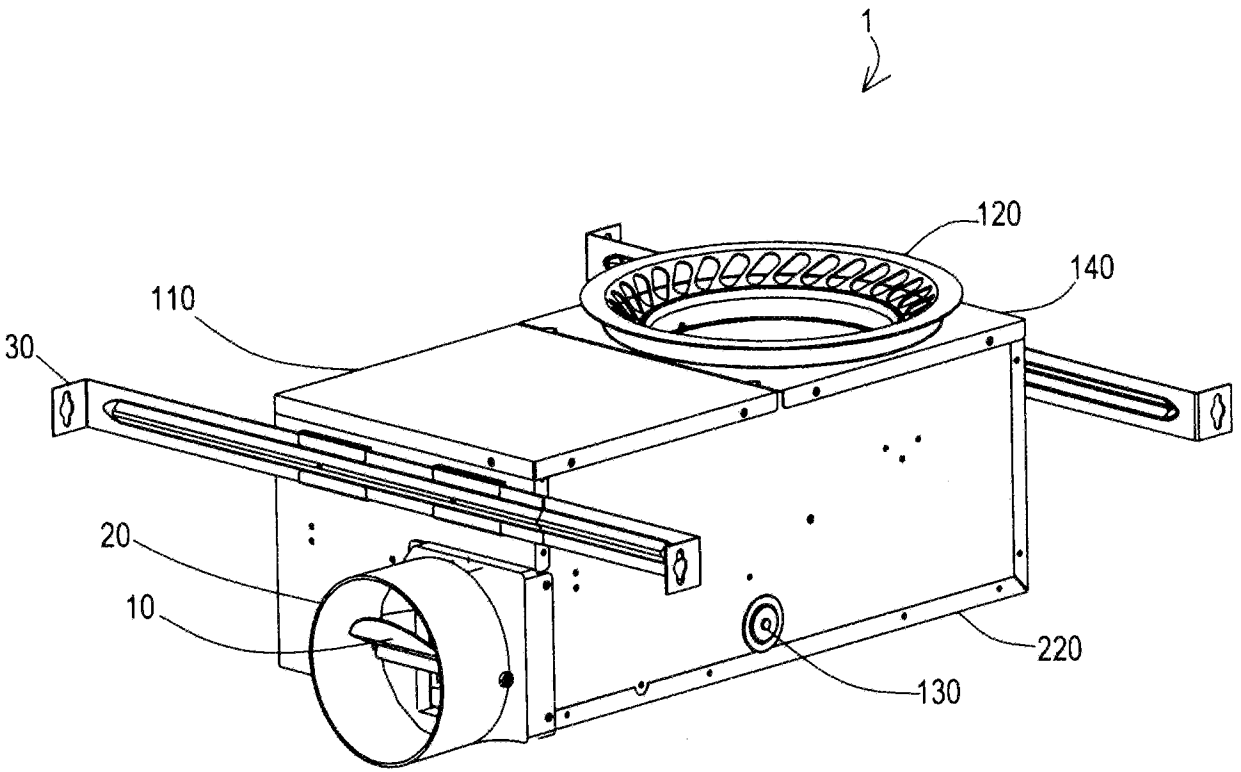
FIG. 10 is another perspective side view of the assembled bath fan of FIG. 9.
Figure 11:
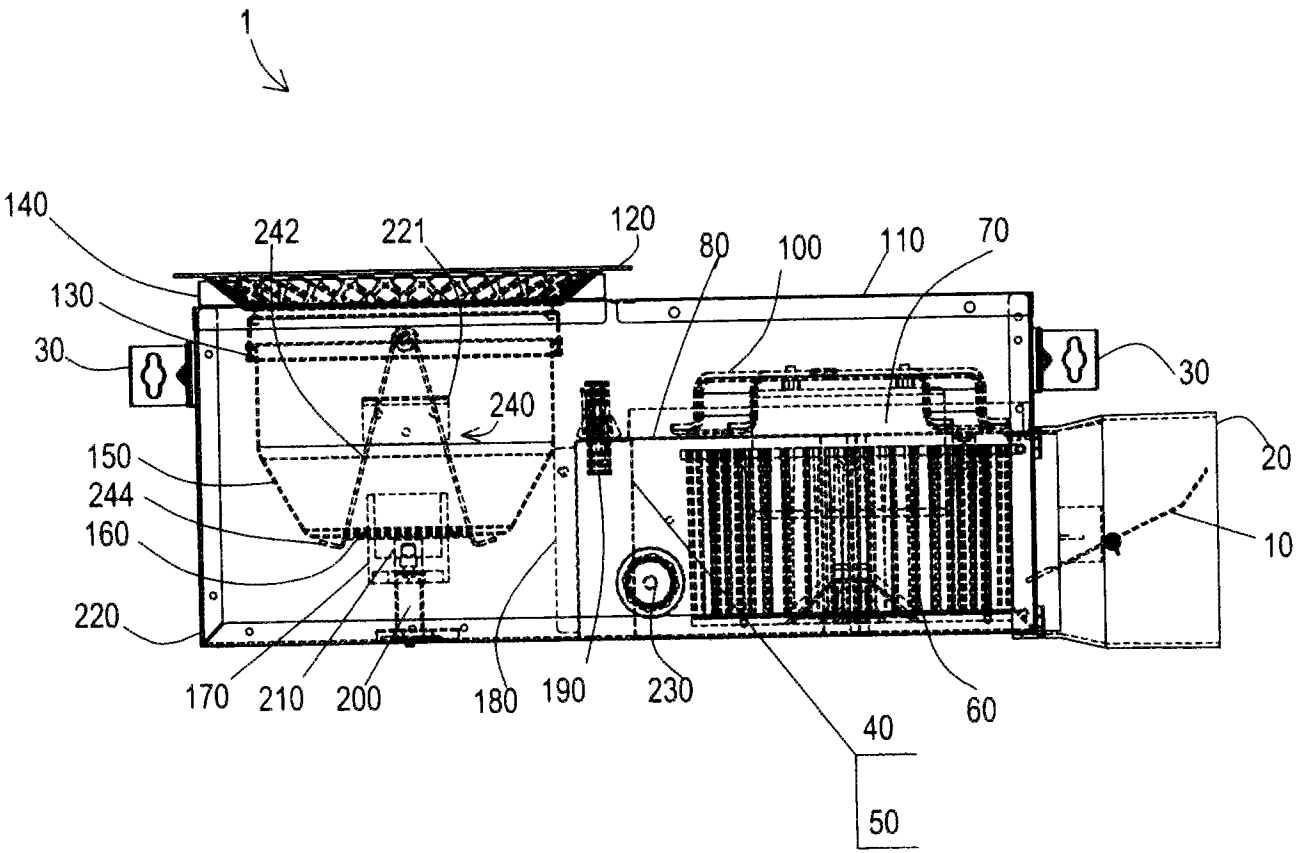
FIG. 11 is a side cross-sectional view of the assembled bath fan of FIGS. 8-10.

FIG. 5 is a perspective top side view of an assembled bath fan 1 of FIG. 1 without the exterior decorative ring 120 and without the outer plate cover 110. FIG. 6 is a top view of an assembled bath fan 1 of FIG. 5 without the exterior decorative ring 120 and without the outer plate cover 110. FIG. 7 is another top view of the assembled bath fan 1 of FIG. 6 with the installed outer plate cover 110 and without the exterior decorative ring 120. FIG. 8 is another top view of the assembled bath fan 1 of FIG. 7 with the outer plate cover 110 and with the exterior decorative ring 120. FIG. 9 is a perspective side view of an assembled bath fan 1 of FIGS. 1 and 8. FIG. 10 is another perspective side view of the assembled bath fan 1 of FIG. 9. FIG. 11 is a side cross-sectional view of the assembled bath fan 1 of FIGS. 8-10.

Referring to FIGS. 1-11, the bath fan 1 can include a generally rectangular housing 220 having four closed sidewalls, and a closed bottom, that can be attached together by fasteners, such as rivets, screws, and the like, together as a single unit. A side opening 223 can allow for a square end 22 of an exhaust outlet 20 to be attached thereto by fasteners, as rivets, screws, and the like. The outlet 20 can have a pivotable damper 10 mounted in the cylindrical exhaust end.

Along opposite sidewalls of the housing 220 can be a slidable telescoping bracket 30 having an elongated portion and opposite bent tab ends 32, 38 having openings for allowing the slidable bracket to be mounted to structures inside of a ceiling such as joists, and the like, with fasteners, such as screws, bolts, and the like. Each bracket 30 can be a single elongated bracket with bent ends, or can be two brackets that telescoping slide into and out of each other. Each bracket 30 can be slidably mounted to sides of the housing by a first pair of bent flanges 34, and a second pair of bent flanges 36 that can be formed from the sidewalls of the housing, wherein each of the pairs 34, 36 wraps about side edges of the elongated portion of the slidable/telescoping brackets 30.

Referring to FIGS. 1-6, and 11, inside the opening 225 of the housing 220 can be an electrical motor 70, such as SP83-413F shaded pole motor, having a rotatable rod 78 that attached to a central axis portion 65 inside of a blower wheel 60, which can be a cylindrical impeller type wheel with fins about the perimeter thereof. The motor 70 with attached impeller (blower wheel) 60 can be mounted to a mid portion of an inverted U-shaped motor bracket 100 by fasteners 76, which can include screws, bolts, nuts, and the like. Footer ends 102, 108 of the inverted U shaped motor mount 100 can be attached to the surface of the motor mount plate 80 by fasteners, such as rivets, screws, and bolts, so that the motor 70 can hang downward through the opening 85 in the motor mount plate 80, with the blower wheel 60 on the other side of the plate 80. Antivibration and anti-noise members, 90 such as rubber pads, and the like, can be sandwiched between the footers 102, 108 and the upper surface of the mounting plate 80.

When attached the impeller 60 with motor 70 can extend through the middle opening 85 of the mounting plate 80. The mounting plate 80 can have bent side edges 84 which allow the mounting plate with mounted motor 70 and impeller 60 to be attached to interior sidewalls of the housing 220 by various removable type fasteners, such as screws and bolts, and the like. The edges 84 can sit on plural ledge clip(s) 221 arranged about an interior perimeter edge inside of the housing 220.

In a preferred embodiment, the blower wheel 60 and motor 70 are preattached by the bracket 100 to the mounting plate 800 so that all of these components can be installed at once, and removed at once. The combined one piece motor/impeller/mount assembly allows inspectors, such as home inspectors, and the like to be able to visually see electrical connections by being able to insert and remove this one-piece assembly of components. Additionally, removing the combined plate 80 with bracket 100 mounted motor 70 and impeller 60 allows for replacement of parts, such as a burned out motor to be more easily accomplished after the fan has been installed.

To direct air from the rotating blower wheel 60, a two piece combination of wind deflector components 40, 50 can be used. Each deflector 40 can be formed from metal such as but not limited to galvanized steel, having curved shapes that can be fastened together by rivets, and the like. The curved plates 40, 50 can be used to guide the airflow and minimizes excess noise. The attached deflectors 40, 50 can be positioned about the opening 85 below the plate 80 within the housing 220.

Referring to FIGS. 7-11, a cover plate 110 having bent edges 114 on three sides can be used to close off the upper opening of the housing 220 above the motor mounting plate 80. Bent edges 114 can be attached to upper edges of the housing by fasteners, such as rivets, screws, bolts, and the like.

Referring to FIGS. 1-6 and 11, a plug panel plate 180 can be installed to separate one half portion of the inside of the housing 220 from another half portion of the housing 220. The plug panel plate 180 can have bent side edges 184 that can be used to attach the plate 180 to interior walls of the housing 220 by fasteners, such as rivets, screws, bolts, and the like. An upper bent edge 186 can have openings 187 for mounting male plug member for motor 72, and male plug member for light 172 thereto. External power lines 198 for motor, and external power line 192 for light can pass through a side opening 229 in the housing 220. Before installation, the side opening 229 can be closed by a plug 230. Removable female receptacle 196 from power line 198 can be used to provide power to the motor 70, while removable female receptacle 190 from power line 192 can be used to provide power to light 170. The plug plate 180 holds both plug-ins for the light 170 and motor 70, so it is like a centralized place for both plugs 72, 172. Plug plate 180 also acts as a separation between the motor side and the light side of the housing 220 to further enclose the bulb area from any airflow contacting the bulb area.

Brackets 210 with bent flange ends 212, 218 can further secure the panel plate 180 to the housing 220. Upper bent ends 212 of brackets 210 can be attached to upper bent edge 186 of panel plate 180, by fasteners, such as screws, bolts, and the like. Lower bent ends 218 of brackets 210 can be attached to the lower interior floor of the housing 220 by fasteners, such as screws, bolts, and the like.

Referring to FIGS. 1-11, mounted to another part of the housing 220 can be the recessed can components 120, 140, 150, 160, 170. The main recessed can component can be a metal lamp shade 150 having a narrow lower open end 152, and enlarged upper open end 158 with an opening therethrough. The lamp shade can have a generally conical lower portion and upper cylindrical portion.

The lamp shade 150 can be secured to the interior floor of the housing 220. A flat ring bottom 151 about the bottom narrow opening 152 in the lampshade 150 can have fasteners 153, such as screws, bolts and the like, that can attach the flat ring bottom 151 of the shade 150 to the floor of the housing 220, as shown in FIGS. 1, 2, 5, and 6.

An inverted U shaped mounting bracket 200 can have footer ends that attach to a floor portion of the housing 220 by fasteners, such as rivets, screws, bolts, and the like. The bottom of a lamp socket 170 can be attached to a midportion of the inverted U shaped bracket 200 by fasteners, such as rivets, screws, bolts, and the like. The socket 170 can support a bulb, such as but not limited to a 75 W PAR 30 flood lamp bulb, and the like. The socket 170 can be mounted in the narrow open end 152 of the lamp shade and sealed in place by an elastomeric ring 160, such as a rubber ring, and the like.

Covering the upper opening above the recessed can (lampshade) 150 can be a light cover plate 140 having a central opening 145 therethrough with an upper ring shape 146 protruding upward from the opening 145. Bent edges 144 on three sides of the panel 140 can attach the panel 140 to side edges of the upper open end 225 of the housing 220 by fasteners, such as rivets, screws, bolts, and the like.

Referring to FIGS. 1, 2, and 11, a pair of spring clips 240 can springably hold the decorative ring 120 with vents 123 to cover the top opening 145 of the light panel cover 140. The pair of spring clips 240 can each be scissor clips each having an apex 243 that can attach to protruding portions along the lower ring edge 124 of the ring cover 120. The ring cover 120 can be attached to the housing 220 by pressing together the legs 242 of the clips 240, so that the bottom bent edges 244 of legs 242 can be inserted to catch into slots in the upper legs of L brackets 221 that are mounted to inner side walls of the housing 220.

The lower ring shape 124 of the decorative ring cover 120 can be inserted into the upwardly protruding ring 145 of the light cover and sealed in place by sealing member 180, which can be an elastomeric ring, such as but not limited to a rubber ring, and the like. The sealing ring 180 is to seal the decorative trim ring 120 so that moisture and air does not enter the bulb area once the bulb is installed.

The sealing members 180 and 160 seal the light to the narrow open bottom end 152 of the lamp shade 150 so that air passing through vents 123 in the rim 122 of the decorative ring cover 120 does not pass into the lamp shade 150 itself. As such, the sealing members 130, 160 prevent air and moisture from the incoming air from contacting light bulbs, and the inside exposed components of the light socket 170.

Figure 12:
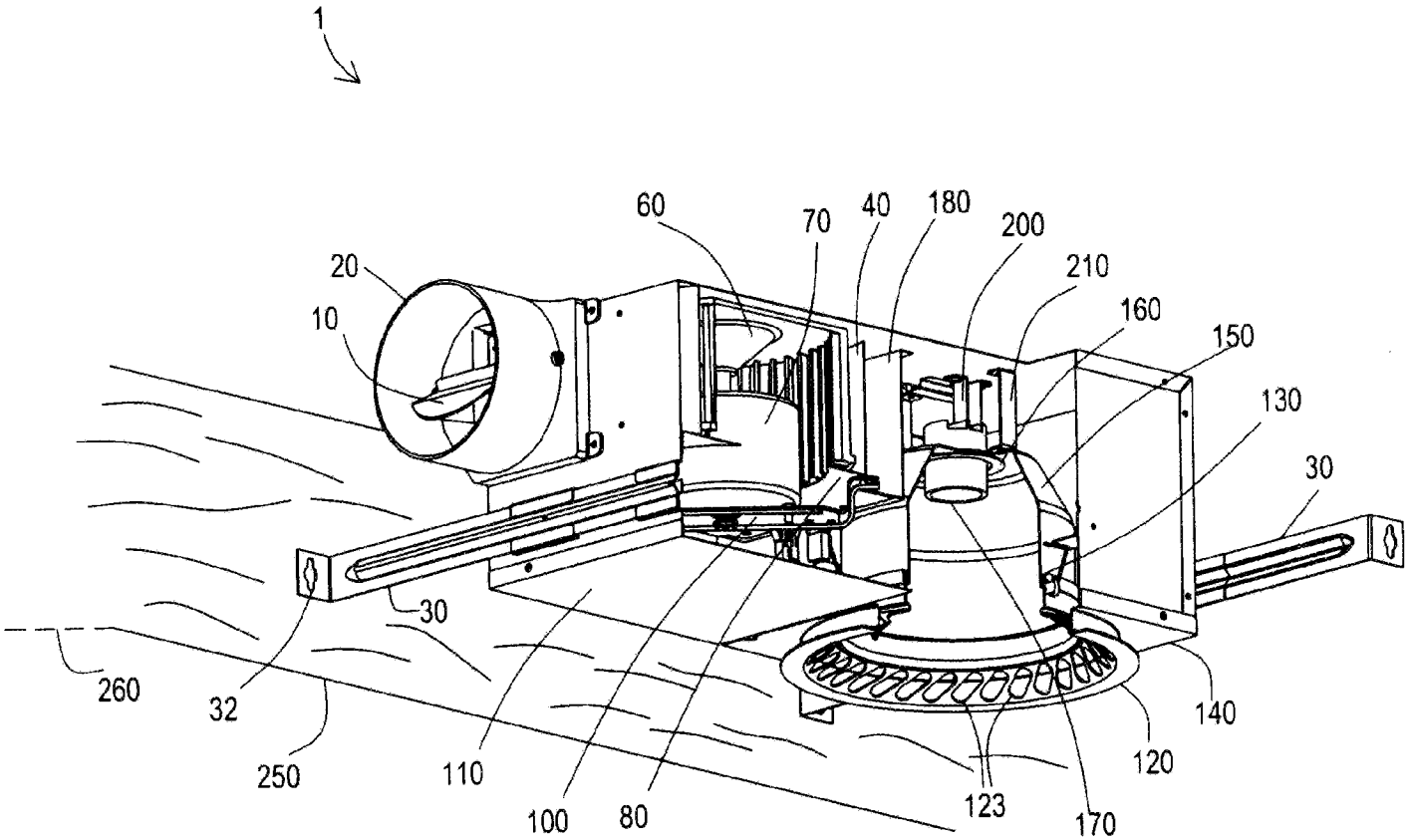
FIG. 12 is another perspective view of the assembled bath fan of FIGS. 8-10 attached to joists within a ceiling.

FIG. 12 is another perspective view of the assembled bath fan 1 of FIGS. 8-10 attached to joists 250 within a ceiling 260. The suspension brackets 30 can extend to fit any standard joist layout. Each side of the housing 220 has a formed bracket members 34, 36 or welded brackets where you can insert the slidable suspension brackets 30. The slidable brackets 30 with bent ends 32, 38 then attaches to the joist 250.

Figure 13:
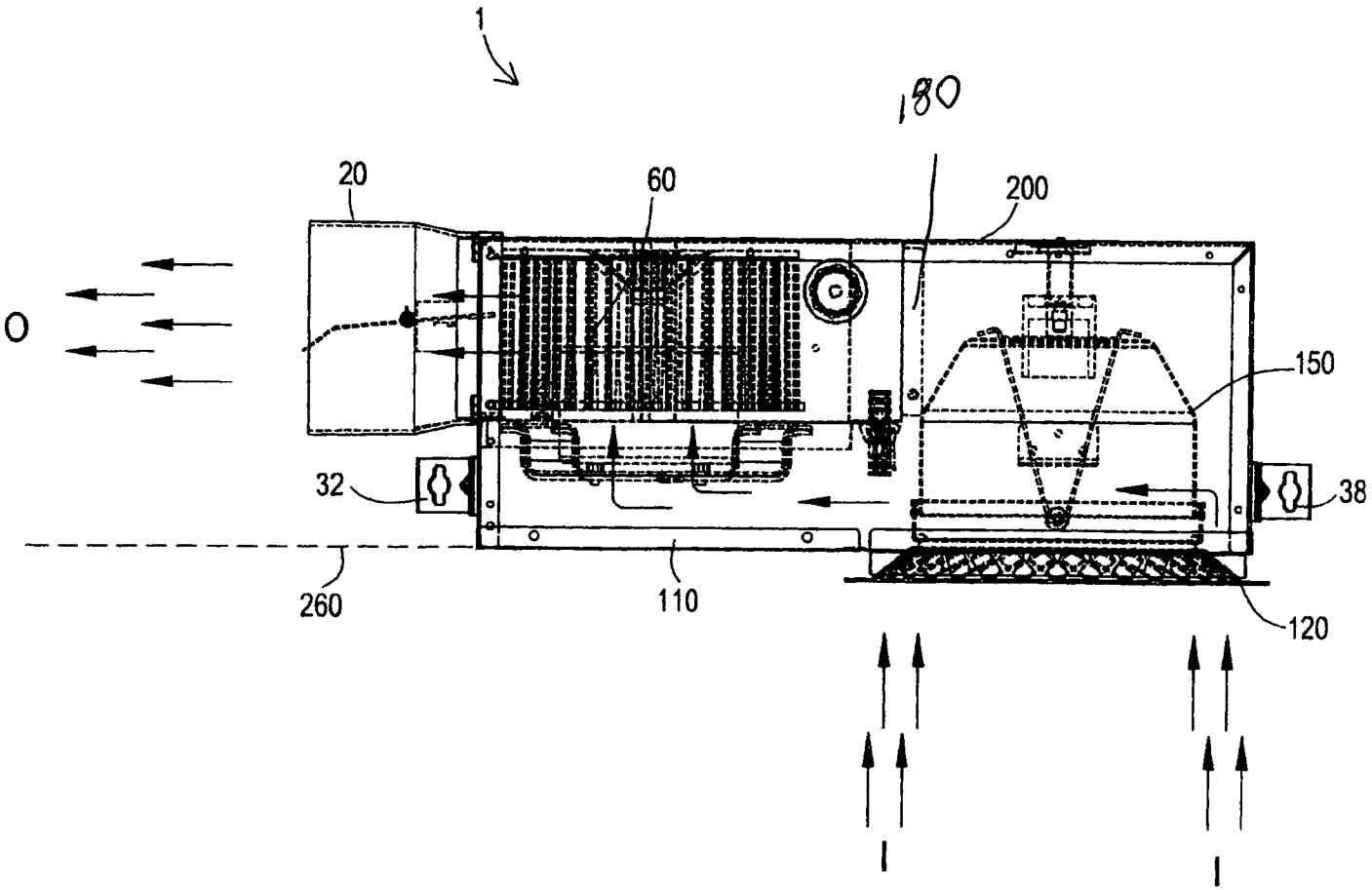
FIG. 13 is a side view of the assembled and ceiling installed bath fan of FIG. 12 showing airflow directions into and out of the bath fan.

FIG. 13 is a side view of the assembled and ceiling installed bath fan 1 of FIG. 12 showing airflow directions into and out of the bath fan 1. As shown, the sealing members 130, 160, prevent incoming air and moisture from bathrooms form passing into the lamp shade 150 and contacting interior light components such as bulbs, and the like.

As previously discussed, the lamp housing 1 completely encloses the bulb/socket area so moisture does not flow near electrical components. Instead the air that is being exhausted enters the vents 123 in the trim ring 120 and then flows around the outer parts of the lamp housing 150 towards the right where the blower wheel exhausts the air to the outlet duct.

The housing can be directly attached to joists and/or other structural members above ceilings and/or behind walls by the slide brackets and/or the ears and flaps.

Although the invention describes the motor as being a 70 CFM (cubic feet per minute) electrical motor, the invention can be used with other CFM generating motors.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A ventilation exhaust fan, comprising:

a housing having top, side walls and bottom, and outlet;

a blower wheel inside of the housing;

a motor in the housing for rotating the blower wheel;

a recessed can mounted to the bottom of the housing adjacent to the wheel and motor, the recessed can having an interior end;

a light in the recessed can adjacent to the interior end;

a solid vertical panel in the housing between the recessed can and the motor mounted blower wheel for separating the recessed can from the motor, the solid vertical panel having an upper end attached to the housing, the vertical panel separating a first compartment having the motor and blower wheel, from a second compartment having the recessed can and the light, the first compartment being side by side with the second compartment, with the first compartment having a closed bottom, beneath the motor and the blower wheel, the solid vertical panel further preventing airflow from the blower wheel contacting the light.

2. The exhaust ventilation fan of claim 1, wherein the solid vertical panel includes:

a first male plug and a first female receptacle on a bent edge of the solid vertical panel connecting power to the light; and a second male plug and a second female receptacle on the bent edge of the solid vertical panel connecting power to the motor.

3. The ventilation exhaust fan of claim 1, wherein the motor is an approximately 70 (seventy) CFM (cubic feet per minute) generating motor.

4. The ventilating exhaust fan of claim 1, further comprising:

an elongated side telescoping bracket directly mounted along the housing for mounting the housing to structural supports within a ceiling.

5. The ventilating exhaust fan of claim 1, wherein the recessed can includes:

a recessed shade.

6. The ventilating exhaust fan of claim 5, further comprising:

a pan having vents about the recessed shade, wherein air enters through the vents into the exhaust fan and passes about an exterior surface of the light shade.

7. The ventilating exhaust fan of claim 6, further comprising:

a sealing ring for sealing the can to the pan, so that moisture and air does not pass into the recessed can.

8. A ventilation exhaust fan, comprising:

a housing having sides, top and bottom;

a blower inside of the housing;

a motor in the housing for running the blower;

a light mounted in a recess in the bottom of the housing; and a solid vertical panel in the housing between and separating the recess from the motor with the blower, the vertical panel separating a first compartment having the motor and blower, from a second compartment having the recess and the light, the first compartment being adjacent the second compartment, the solid vertical panel further preventing airflow from the blower contacting the light.

9. The ventilation exhaust fan of claim 8, wherein the first compartment includes:

a closed bottom wall beneath the motor and the blower.

10. The ventilation exhaust fan of claim 8, wherein the solid vertical panel includes:

a first male plug and a first female receptacle on a bent edge of the solid vertical panel connecting power to the light; and a second male plug and a second female receptacle on the bent edge of the solid vertical panel connecting power to the motor.

11. The ventilation exhaust fan of claim 8, further comprising:

a ring shaped pan having vents about a perimeter edge of the pan positioned about the recess, the vents for allowing incoming air to pass into the housing by the blower.

12. The ventilation exhaust fan of claim 8, further comprising:

a sealing member attached to the recess for preventing the incoming air from entering into the recess and contacting the light.

13. The ventilation exhaust fan of claim 11, wherein the sealing member includes:

a sealing ring for sealing the recess to the ring shaped pan, so that moisture and air does not pass into the recess.

14. The ventilation exhaust fan of claim 12, wherein the sealing member includes;

a first sealing ring for sealing the recess to the ring shaped pan, so that moisture and air does not pass into the recess; and a second sealing ring for sealing the recess to the light, so that moisture and air does not pass into the recess.

15. The ventilation exhaust fan of claim 8, further comprising:

a motor mounting plate having an opening therethrough; and a generally U-shaped motor bracket attached to the motor mounting plate for mounting the motor in the opening of the motor mounting plate, with the blower to one side of the motor mounting plate, wherein the motor mounting plate with the mounted motor and blower are both insertable into the housing as a single unit, and are removable from the housing as the single unit.

16. The ventilation exhaust fan of claim 8, further comprising:

an elongated side telescoping bracket directly mounted along the housing for mounting the housing to structural supports within a ceiling.

17. A ventilating exhaust fan comprising:

a housing having sides, top, bottom, and an outlet;

a blower inside of the housing;

a motor for running the blower;

a light attached to the housing; and a solid vertical panel in the housing between and separating the motor with the blower wheel, and the light, the vertical panel separating a first compartment having the motor and blower, from a second compartment, the first compartment being adjacent the second compartment, with the first compartment having a closed bottom under the motor and the blower, the solid vertical panel further preventing airflow from the blower from contacting the light.

18. The ventilating exhaust fan of claim 17, wherein the solid vertical panel includes:

a first male plug and a first female receptacle on a bent edge of the solid vertical panel connecting power to the light; and a second male plug and a second female receptacle on the bent edge of the solid vertical panel connecting power to the motor.

19. The ventilating exhaust fan of claim 17, further comprising:

vents about the light for allowing incoming air to pass into the vents.

20. The ventilating exhaust fan of claim 19, further comprising:

a seal for preventing air coming into the housing from contacting the light.

* * * * *